United States Patent [19]

Hoshino

[11] Patent Number: 5,044,249

[45] Date of Patent: Sep. 3, 1991

[54] HIGH HAT STAND WITH MECHANICAL ADVANTAGE WITH TWO SPROCKETS

[75] Inventor: Yoshihiro Hoshino, Nagoya, Japan

[73] Assignee: Hoshino Gakki Co., Ltd., Japan

[21] Appl. No.: 573,985

[22] Filed: Aug. 28, 1990

[30] Foreign Application Priority Data

Mar. 1, 1990 [JP] Japan ..... 2-50170

[51] Int. Cl.[5] ..... G10D 13/00

[52] U.S. Cl. ..... 84/422.3

[58] Field of Search ..... 84/422.1–422.4

[56] References Cited

U.S. PATENT DOCUMENTS 4,898,062 2/1990 Hoshino ..... 84/422.3

4,905,565 3/1990 Hoshino ..... 84/422.3

*Primary Examiner*—Lawrence R. Franklin

*Attorney, Agent, or Firm*—Ostrolenk, Faber, Gerb & Soffen

[57] ABSTRACT

A high hat stand comprising a stationary cymbal on a stationary support, a movable cymbal above the stationary cymbal and movable down into engagement with the stationary cymbal, a spring urging the movable cymbal away from such engagement, and a pedal connected with the movable cymbal operating rod for operating the movable cymbal against the urging of the spring. Two sprocket wheels of different diameter are supported on an axis fastened on the cymbal operating rod. A first strap in the form of a chain extends from the pedal over the first sprocket. A secondf strap in the form of a chain extends from the second sprocket to a stationary support. The arrangement causes selected movement of the pedal to cause a different extent of movement of the cymbal operating rod, a different force to move the cymbal, and changes the rate of return of the pedal and enables a spring of a different selected spring force to be used than the foot force that is applied to the pedal.

16 Claims, 6 Drawing Sheets

FIG. 3A
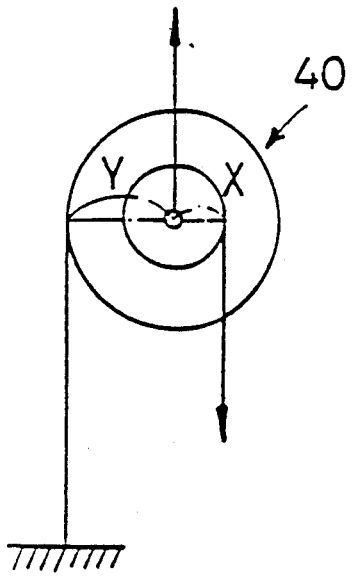
FIG. 3B
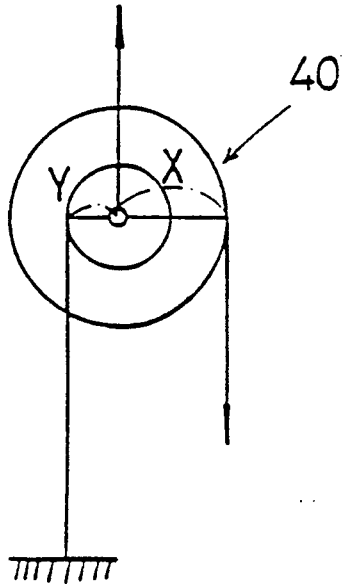
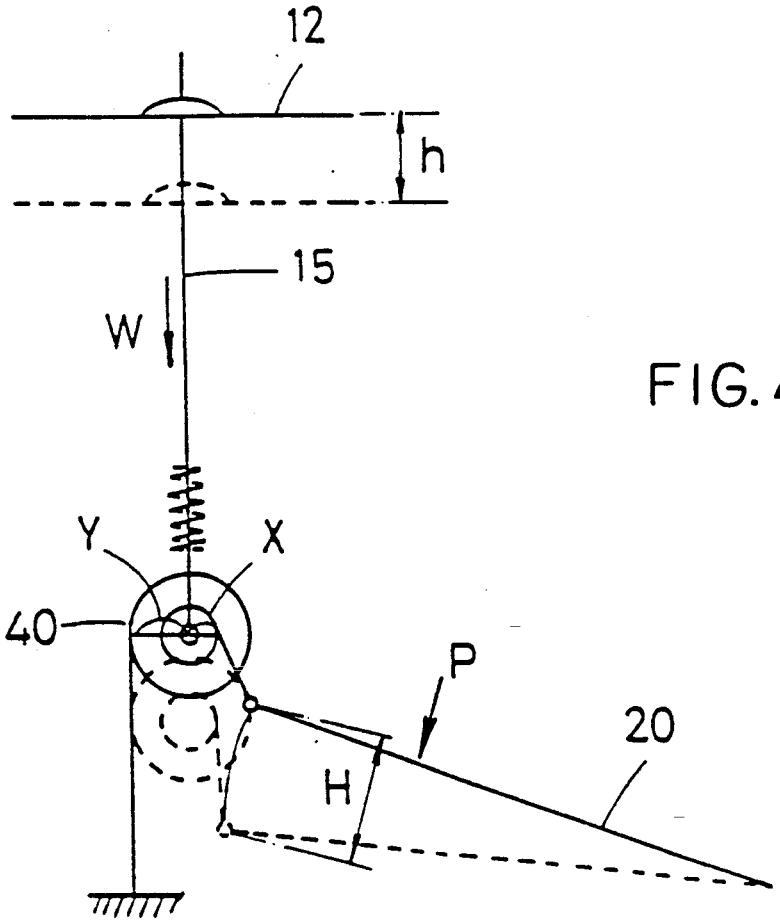
FIG. 4

HIGH HAT STAND WITH MECHANICAL ADVANTAGE WITH TWO SPROCKETS

BACKGROUND OF THE INVENTION

1. Field of the Invention

The present invention relates to a high hat stand for cymbals with improved pedal operation at the time of performance.

2. The Prior Art

A high hat stand comprises a lower fixed cymbal and an upper movable cymbal. The upper movable cymbal is connected to and is moved vertically through longitudinal motion of an operating rod which is connected to and is thereby operated by the vertical movement of a pedal at the lower part of the stand. The operating rod of the upper movable cymbal is continuously biased upwardly by a spring. The performer therefore controls the movable cymbal by stepping on the pedal or releasing it. As the upper cymbal moves down against the lower fixed cymbal or opens away from it, the cymbals perform.

In this kind of high hat stand, quick and accurate action or responsive action of the movable cymbal is required for the best performance. For the mechanism, this responsiveness reflects the light movement and quick restoration of the position of the pedal that moves the operating rod. It is necessary for the spring to be made weaker in order for the pedal to be able to be stepped in lightly against the continual upward force applied to the operating rod by the spring. In order for the pedal to be restored to its start position quickly, the spring has to be made stronger. These two requirements contradict each other.

In addition, a mechanism for enabling delicate opening and closing of the cymbals or for causing the cymbals to remain tightly closed in the closed state while permitting the cymbals to open or close slightly by a delicate pedal operation is required for a good musical performance.

In a conventional high hat stand, the cymbal operating rod is joined directly to the pedal so that the rod moves to the same extent and distance as the part of the pedal to which the rod is connected. Therefore, a force equal to the spring force is required for stepping in the pedal.

Also known is a high hat stand wherein the pedal is joined through a chain or strap to a sprocket or pulley rotatably mounted on the vertically movable cymbal supporting and operating rod. See, for example, U.S. Pat. No. 4,905,565. But the pedal and rod motion are still directly related and the mechanical advantage motion disclosed herein is not suggested.

In these directly connected structures, no improvement has been made on the above described requirements despite a number of so called improvements, which have merely changed the performer's feeling on stepping in through changing the strength of the spring or the size of the resistance.

SUMMARY OF THE INVENTION

Objects of the invention include providing a high hat stand, wherein the pedal can be stepped in more lightly, the restoration of the pedal to its original position is speedy, the cymbals can be pushed together tightly, delicate pedal operation is possible and cymbal responsiveness is very satisfactory.

A further object is to enable the straightforward movement of the cymbal operating rod and to guarantee the smooth movement of the rod and the smooth operation of the cymbal.

Through experiments, the present inventor realized that the above requirements could not be met so long as the pedal and the cymbal operating rod are directly connected for moving the rod to the same extent as the pedal. He realized that a new dynamic structure to provide improved performance is to connect the pedal and the cymbal operating rod through rotary members, applying the principle of mechanical advantage of a movable pulley arrangement.

In the invention, a high hat stand includes a cymbal operating rod which is moved vertically by the movement of the foot pedal. The cymbal operating rod supports a common rotary shaft extending transverse to the rod. Two coaxial rotary members or wheels, and particularly sprockets, one larger and one smaller in diameter, rotate together on the common rotary shaft around the axis at the shaft. Both wheels are caused to together simultaneously rotate with the shaft through a first strap, chain, or the like connection between the pedal and one wheel or sprocket on the common shaft and through a second strap, chain, or the like from the second wheel on the shaft to a stationary connection like the support for the stand. This arrangement, which includes two wheels or sprockets of different size, and particularly different diameters, acts like a pulley system, experiencing the effects of the mechanical advantage of such a system. A spring normally urges the cymbal operating rod and the movable cymbal away from the stationary cymbal.

Other objects and features of the invention are explained with reference to the attached drawings.

BRIEF DESCRIPTION OF THE DRAWINGS

FIG. 3 shows the principle governing the action of the invention.

FIG. 4 conceptually expresses the action of a high hat stand according to the invention.

DESCRIPTION OF PREFERRED EMBODIMENTS

Figure 1:
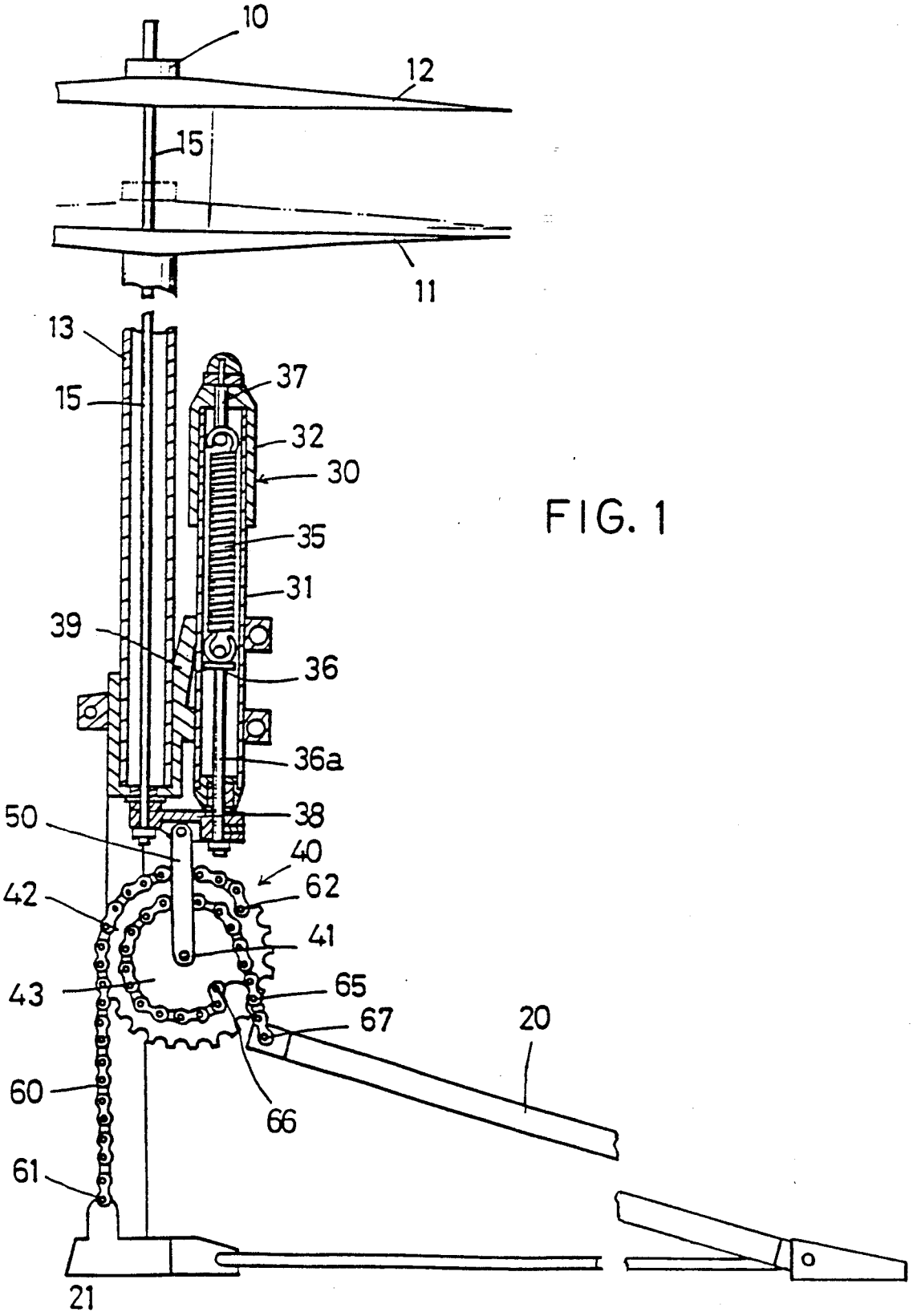
FIG. 1 is a vertical section of a high hat stand showing an example of the invention.

The overall structure of a high hat stand according to the invention is explained with reference to FIG. 1. A cooperating lower fixed cymbal 11 and upper movable cymbal 12 are arranged at the top part of a high hat stand 10. The lower cymbal 11 is fixed to the stationary main pipe 13 at the support of the stand. The upper movable cymbal 12 is installed on and moves together with a cymbal operating rod 15 that passes through the hollow main pipe 13. The cymbal 12 moves vertically in conformity with the vertical movement of the operating rod 15. Such movement either joins the cymbal 12 with or opens it away from the lower fixed cymbal 11.

The operating rod 15 of the upper movable cymbal 12 is given an upward bias at all times by a spring. The spring device 30 includes a main cylindrical body 31 and a spring bias adjusting cap 32 that is screwed to the top of the body 31. A coil spring 35 is maintained in the body 31 so as to be freely expanded or contracted between the lower spring receiving member 36 toward the bottom of the main body 31 and the upper spring receiving member 37 on the adjusting cap 32. The main body 31 of the spring device 30 is installed on the main pipe body 13 of the stand by a bracket 39. The rod 36a of the lower spring receiving member 36 is joined with the operating rod 15 through the lateral connecting bracket 38 between the rods 36a and 15 to provide the operating rod 15 with a continuous upward bias.

In an alternate arrangement, the spring that biases the operating rod 15 is wound directly on the operating rod 15 inside the main pipe body 13 and that construction would function in the same manner.

There is a plate like foot pedal 20 which is pivotally attached to a stationary seat plate at the rear end of the pedal so that the front of the pedal pivots vertically toward and away from the cymbals.

In the invention, further, the cymbal operating rod 15 and the foot pedal 20 are connected through a rotatable assembly, particularly wheel assembly 40, that acts like a movable pulley assembly. The wheel assembly comprises two rotary members, of large and small diameters, 42 and 43, in the form of strap receiving wheels or chain receiving sprockets that are concentrically fixed on the common rotary shaft 41 and rotate together and as a unit with the shaft. These operate the cymbal operating rod 15 by the foot pedal 20.

Figure 2:
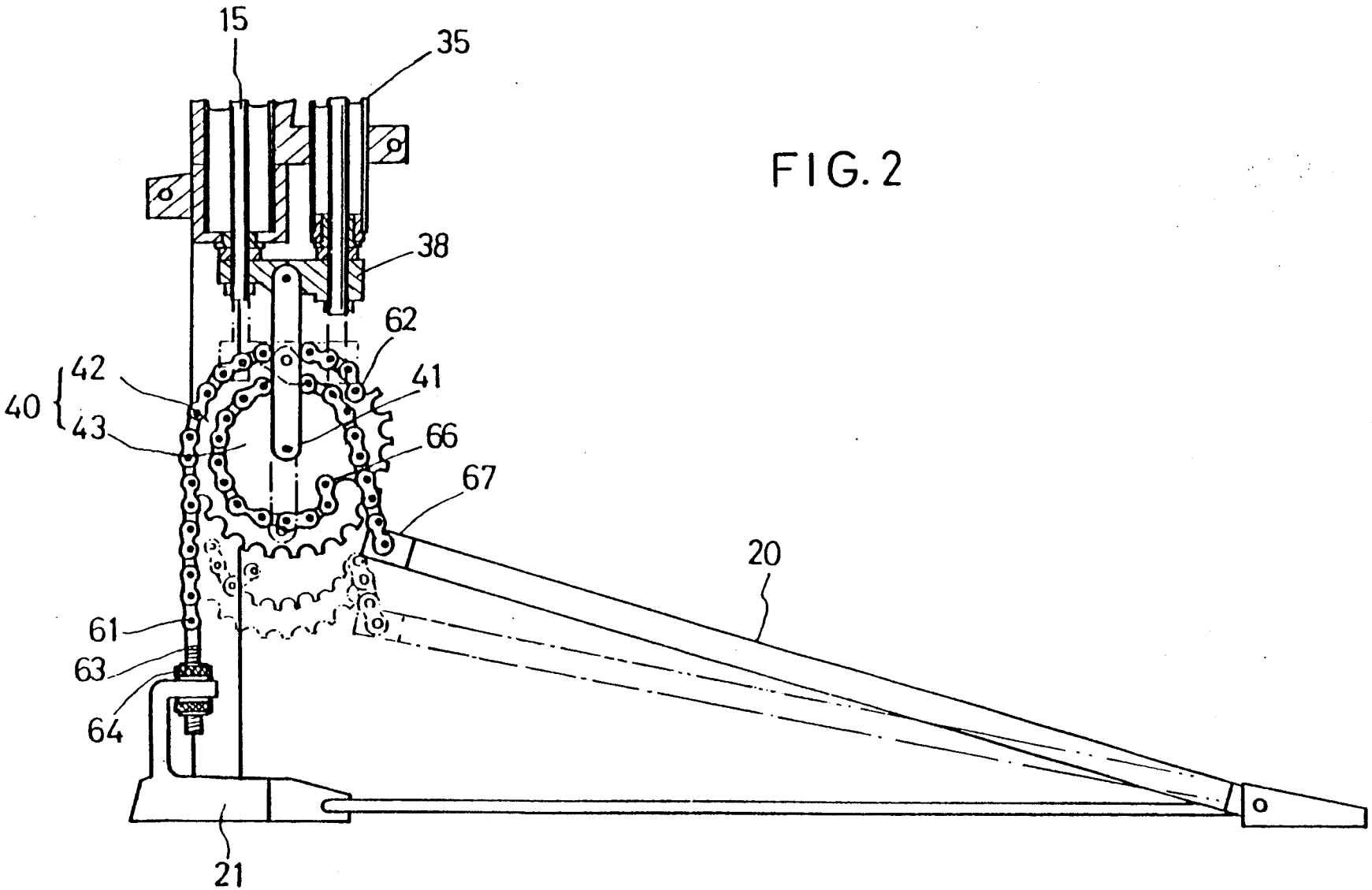
FIG. 2 is a cross-section of an essential part of the high hat stand, showing another embodiment.

Referring to FIGS. 1 and 2, the cymbal operating rod 15 is linked to the common rotary shaft 41 of the wheel assembly 40 by a connecting lever 50 which is attached, possibly swingably, at the center of the connecting bracket 38. The wheel assembly 40 is suspended on the connecting bracket 38 by means of the lever 50.

Two straps in the form of chains 60 and 65 are respectively wrapped around the peripheries of the two rotary members 42 and 43 so that the wheel assembly 40 rotates as a movable pulley and also simultaneously moves vertically.

A fixed side strap or link chain 60 has a front end 61 which is fixed to the front seat plate 21 of the stand, and the chain 60 is wound on the large diameter wheel or toothed sprocket 42, where it is attached to the sprocket 42 at the installation part 62.

A movable side strap or link chain 65 has a rear end 67 which is fixed to the front end of the foot pedal 20 and is wound on the small diameter wheel or sprocket 43 where it is attached to the sprocket 43 at the installation part 66.

In this example, the fixed side chain 60 is wound on the large diameter wheel 42 while the movable side chain 65 is wound on the small diameter wheel 43. However, the opposite arrangement may be adopted. This will be further explained along with the description of the operation of this high hat stand.

As shown in FIG. 2, the length of the chain 60 can be adjusted freely when the front end 61 of the fixed side chain 60 is fixed to a bolt 63 which is movable up and down by an adjusting nut 64 on the support 21. This makes it possible to adjust the height of the pedal 20.

It is possible to employ only partial sprockets in place of the full sprockets that are shown in the drawings.

Figure 7:
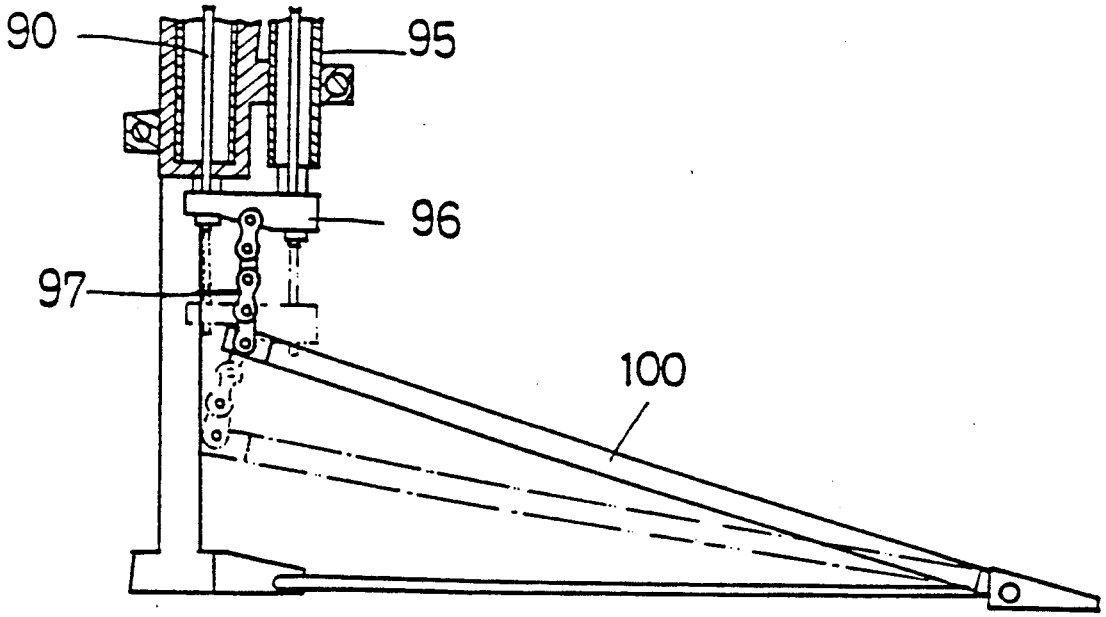
FIG. 7 is a cross-section through a part of one prior art device.

A conventional high hat stand is shown in FIG. 7. The cymbal operating rod 90 is directly joined with the pedal 100 with a result that the operating motion and travel distance of the pedal 100 is the same as for the cymbal operating rod 90. In addition, a force which is of the same size as the spring pressure of the spring device 95 is required for stepping in the pedal 100. A connecting member 96 joins the spring (not shown) of the spring device 95 with the operating rod 90. A chain 97 joins the connecting rod 96 with the pedal 100. The below described benefits of the invention are not achieved.

FIG. 3 shows the principle of a movable pulley, which governs the action of the high hat stand according to the invention. The rotary member that is connected with the pedal has the radius X. The rotary member that is linked to the fixed side of the pedal stand has the radius Y. Two cases are shown in FIGS. 3A and 3B. In FIG. 3A, as in FIG. 1, Y is larger than X. In FIG. 3B, X is larger than Y.

FIG. 4 conceptually shows the principle governing the action of the high hat stand arranged as in FIGS. 1, 2 and 3A. When the cymbal operating rod 15 and the pedal 20 are connected through a wheel assembly 40 which acts like a pulley, the following equation becomes valid from the principle governing the pulley.

The force W that is required to pull down the movable cymbal 12 multiplied by the distance h through which the cymbal 12 moves equals the stepping force P on the pedal multiplied by the distance H over which the part of the pedal, to which the chain is connected, moves during operation of the pedal 20 or PH=Wh.

From the above, the following relationship can be derived:

$$H=h+X/Y(h)=(1+X/Y)h$$

$$h=Y/(X+Y)H$$

$$P=Y/(X+Y)W$$

$$W=(1+X/Y)P$$

Accordingly, the force that is required to pull down the cymbal (W) against the spring or the force with which the pedal is stepped in (P) becomes smaller than in the conventional device.

On the other hand, the distance (H) which the pedal moves down to pull down the movable cymbal 12 over a distance (h) becomes larger than in the conventional device, i.e. the stroke of the pedal becomes larger.

This is explained further by referring to an exemplary actual high hat stand. FIGS. 5A–D show a case where a foot pedal 20 is linked to the small wheel 43 of the wheel assembly 40 as in FIGS. 1–4, with X being smaller than Y. On the other hand, FIGS. 6A–D show the case where the foot pedal 20 is linked to the large wheel 42 with X being larger than Y. A comparison between these examples and conventional products is shown in Table 1, which is affixed at the end of this specification.

FIG. 5 shows the case where the ratio X : Y is 1 : 2. The following relationship is then obtained from the aforementioned equations: The distance over which the pedal 20 moves is (H)=3/2 h. The force with which the pedal is stepped in is (P)=⅔ W.

Figure 5A:
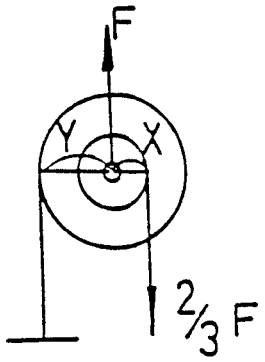
FIGS. 5A–D are conceptual drawings expressing the operations of the invention.

In FIG. 5A, if the spring pressure that is applied to the cymbal operating rod is F, then the force that is required to step in the pedal can sufficiently be ⅔ F. This is equivalent to saying that, if the spring pressure remains the same as in the conventional case (product A in Table 1), smaller force is required to step in the pedal using the invention. Otherwise, it means that a spring whose spring pressure is greater than in the conventional high hat stand can be employed. Invention B in Table 1 indicates the fact that, even with a spring whose spring pressure is 1.5 times as large as in the conventional high hat stand, the pedal can be stepped in with a force which is the same as in the conventional high hat stand.

Figure 5B:
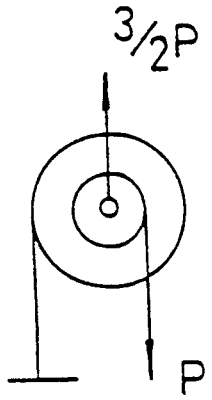

FIG. 5B shows that, based upon the same principle, a force of 3/2 P (1.5 times) is applied to the movable cymbal at the time when the pedal is stepped in with the force P in a closed state where the movable cymbal and the fixed cymbal are joined together. Although, in actuality, the cymbal is pressed with a force of 3/2P−F, the cymbals are joined firmly, as compared with the conventional force of P−F, and the tight closure of the cymbals makes it possible to give a pleasing performance.

Figure 5C:
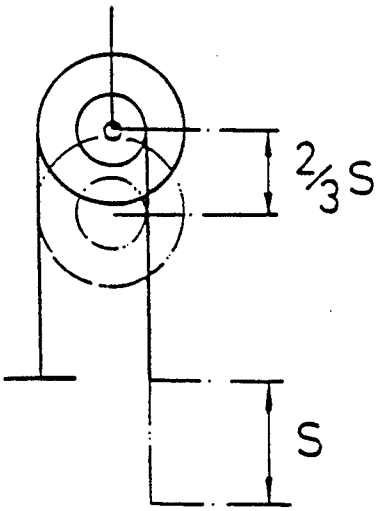

FIG. 5C indicates that when the pedal is moved S millimeters, the cymbal is moved $\frac{2}{3}$ S millimeters. Pedal operation can be carried out delicately and this is particularly useful in a performing technique where the cymbals are closed once, followed by a delicate opening and a subsequent closing.

Figure 5D:
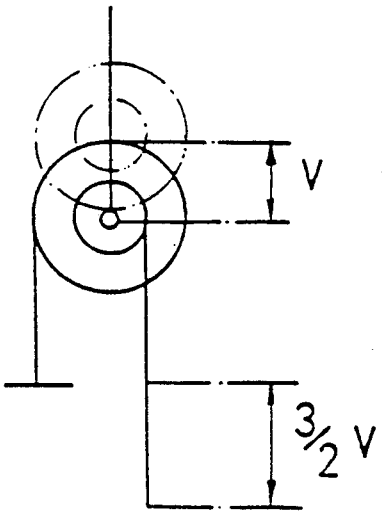

FIG. 5D indicates the speed at which the pedal is restored. When the cymbal operating rod returns at the speed V, the pedal is restored at the speed 3/2 V. The pedal plate is restored to its original position so as to effectively adhere to the sole of the performer's foot. This gives the performer a pleasant feeling and enhances the performing technique.

FIG. 6 shows the case where the ratio X : Y is 2 : 1 and where the foot pedal is linked to the large wheel of the wheel assembly. The following relationship exists: The distance over which the pedal moves is (H)=3h, and the force which the pedal is stepped in (P)=$\frac{1}{3}$ W.

Figure 6A:
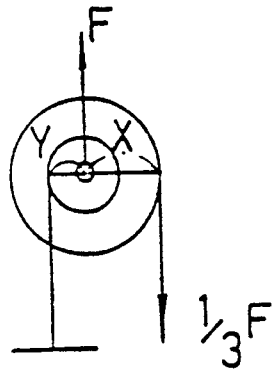
FIGS. 6A–D are conceptual drawings expressing the operations of another example of the invention.

As in FIG. 5, if the spring pressure that is added to the cymbal operating rod in FIG. 6A is expressed by F, the force required for stepping in the pedal will sufficiently be $\frac{1}{3}$ F. Invention D in Table 1 shows the case where a spring having a spring force that is twice as large as in a conventional high hat stand was used. Even in this case, it becomes possible to step in the pedal with a force which is $\frac{2}{3}$ of the force used in a conventional high hat stand.

Figure 6B:
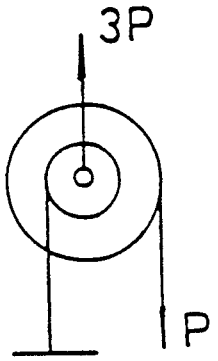

FIG. 6B indicates the closed state of the cymbals, where the movable cymbal is joined against the fixed cymbal. When the pedal is stepped in with a force of P, the movable cymbal has a force of 3 P applied on it. In actuality, the cymbal is held under a force of 3P−F, with F being the opposing pressure of the spring, as has been described earlier.

Figure 6C:
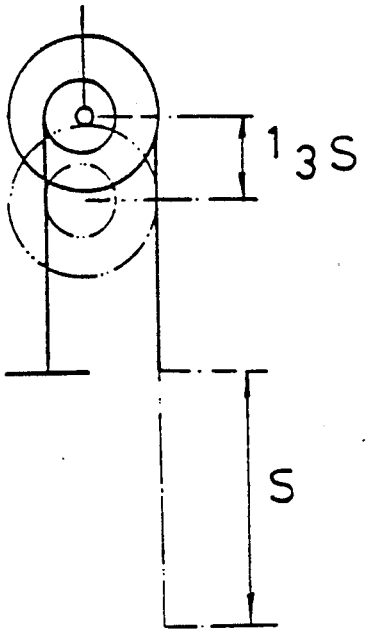

FIG. 6C indicates that when the pedal is moved over S millimeters, the cymbal moves over $\frac{1}{3}$ S millimeters.

Figure 6D:
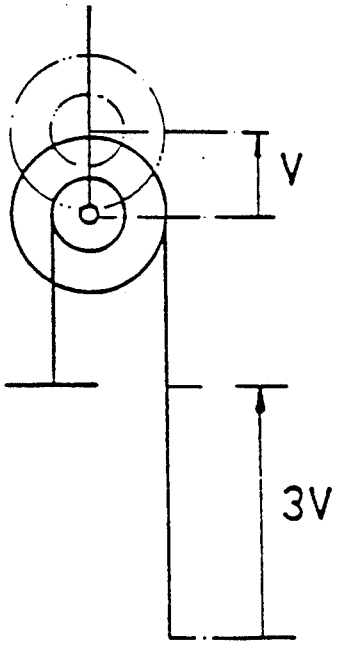

Moreover, FIG. 6D shows the speed at which the pedal is restored When the cymbal operating rod returns at the speed V, the pedal is restored at the speed of 3 V, giving the performer great comfort.

The high hat stand according to the invention uses a movable pulley comprising two wheels, one large and the other small, for the connection between the pedal and the cymbal operating rod. This high hat stand has superior operation based on the principle that governs a pulley. It becomes possible to use a smaller force to step in the pedal. This drastically changes the pedal stepping feeling, thereby markedly improving the operating performance. If necessary, a stronger movable cymbal operating rod biasing spring can be used than conventionally. This also broadens the range of the specifications for the springs that can be used.

In addition, since it becomes possible to press the cymbal with a stronger force, it becomes possible to effect a tight closing of the cymbals, thereby effecting a sharp performance.

Since the operating distance of motion of the pedal can be made greater than the operating distance of the cymbal operating rod, it becomes possible to carry out delicate movements easily. It is possible to effect the repetitive operation of opening and closing the cymbals in short periods of time.

In addition, a pedal that has been stepped in can be restored to its original position more quickly, with the pedal giving such a feeling that it remains in contact with the sole of the foot of the performer, thus giving the performer a desirable feeling and improving his performing technique.

In this manner, the invention provides a high hat stand which is extremely responsive and which offers satisfactory performance and operation.

TABLE 1

| | Conventional product | Invention A X:Y = 1:2, with the spring pressure being the same as in the past | Invention B X:Y = 1:2, with the spring pressure being greater than in the past (1.5 times) | Invention C X:Y = 2:1, with the pressure of the spring being the same as in the past | Invention D X:Y = 2:1, with the spring pressure being greater than in the past (twice) |
|---|---|---|---|---|---|
| Set pressure of the spring | F | F | 3/2 F | F | 2 F |
| Force required for the pedal | F | $\frac{2}{3}$ F (light) | F | $\frac{1}{3}$ F (light) | $\frac{2}{3}$ F (light) |
| Compressive force of the cymbal (when the pedal force is P) | P − F | 3/2 P − F (closes tightly) | 3/2 P − 3/2 F (closes tightly) | 3 P − F (closes tightly) | 3 P − 2 F (closes tightly) |
| Distance cymbal moves when the pedal moves S mm | S | $\frac{2}{3}$ S (capable of delicate action) | $\frac{2}{3}$ S (capable of delicate action) | $\frac{1}{3}$ S (capable of delicate action) | $\frac{1}{3}$ S (capable of delicate action) |
| Speed at which the pedal is restored | V | 3/2 V (fast) | 3/2 V (1 + α1) (faster by portion by which spring is stronger (α1)) | 3 V (fast) | 3 Y (1 + α2) (faster by portion which spring is stronger (α2)) |

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A high hat stand comprising:

a support; a stationary cymbal supported on the support;

a movable cymbal selectively movable toward engagement with and away from engagement with the stationary cymbal;

a rotatable assembly supported to move with the movable cymbal as the movable cymbal moves with respect to the stationary cymbal, the rotatable assembly including a common rotation axis supported on the movable cymbal and movable with the movable cymbal;

the rotatable assembly comprising a first rotary member and a second rotary member, both supported on the rotation axis and the rotary members being connected for rotation together; one of the first and second rotary members being of a larger diameter and the other being of a smaller diameter;

a movable cymbal operating pedal for being moved by a performer;

first connecting means connecting the pedal with the first rotary member for moving the first rotary member to rotate as the pedal is moved, the pedal being so connected with the first rotary member that as the pedal is moved, it both rotates the first rotary member around the axis and moves the first rotary member and the movable cymbal along with it to move the movable cymbal with respect to the stationary cymbal;

second connecting means connecting the second rotary member with the support at a location on the support such that movement of the pedal moves the first rotary member to move the second rotary member to both rotate and to move the axis to move the movable cymbal with respect to the stationary cymbal.

2. The high hat stand of claim 1, wherein the first connecting means comprises a first strap connected with the pedal and wrapped over the first rotary member such that movement of the pedal moves the first strap to rotate the first rotary member and also to move the first rotary member to move the movable cymbal with respect to the stationary cymbal; and the second connecting means comprises a second strap connected to the support and wrapped over the second rotary member such that movement of the pedal and movement of the first rotary member rotates the second rotary member to wrap the second strap around the second rotary member thereby to move the second rotary member and the axis and the movable cymbal with respect to the stationary cymbal.

3. The high hat stand of claim 2, further comprising an operating rod extending between the movable cymbal and the axis of the rotatable assembly, and the rotatable assembly being rotatably mounted on the connecting rod.

4. The high hat stand of claim 3, further comprising a spring connected with the movable cymbal for urging the movable cymbal away from engagement with the stationary cymbal, and the pedal being operable for moving the movable cymbal toward engagement with the stationary cymbal and against the urging of the spring.

5. The high hat stand of claim 4, wherein the movable cymbal is above the stationary cymbal, the pedal is below the stationary cymbal and the pedal is operable against the urging of the spring to move the movable cymbal down into engagement with the stationary cymbal.

6. The high hat stand of claim 3, further comprising a lever between the rotatable assembly axis and the operating rod, the rotatable assembly being rotatably supported on the axis and the axis being on the lever, and the lever being swingably supported on the operating rod.

7. The high hat stand of claim 3, further comprising a bracket between the operating rod and the spring, and the spring acting upon the movable cymbal via the bracket and the operating rod; the rotatable assembly axis being supported on the bracket 8. The high hat stand of claim 7, further comprising a lever between the rotatable assembly axis and the operating rod, the rotatable assembly being rotatably supported on the axis and the axis being on the lever, and the lever being swingably supported on the operating rod.

9. The high hat stand of claim 2, further comprising a spring connected with the movable cymbal for urging the movable cymbal away from engagement with the stationary cymbal, and the pedal being operable for moving the movable cymbal toward engagement with the stationary cymbal and against the urging of the spring.

10. The high hat stand of claim 9, wherein each of the first and second rotary members has a side toward and a side away from the movable cymbal; both the first and the second straps wrap over the respective side of the first and second rotary members that is toward the movable cymbal; the first strap being connected to the pedal at the side of the first rotary member that is away from the movable cymbal, and the second strap being connected to the support also at the second side of the rotary member that is away from the movable cymbal.

11. The high hat stand of claim 10, wherein the movable cymbal is above the stationary cymbal, the pedal is below the stationary cymbal and the pedal is operable against the urging of the spring to move the movable cymbal down into engagement with the stationary cymbal.

12. The high hat stand of claim 9, wherein the pedal is supported to pivot and the first strap is connected to the pedal at a location spaced away from the pivot of the pedal, such that as the pedal pivots, the first strap is moved by the pedal to rotate the first rotary member and move the axis to move the movable cymbal.

13. The high hat stand of claim 2, wherein the first rotary member is of larger diameter than the second rotary member.

14. The high hat stand of claim 2, wherein the second rotary member is of larger diameter than the first rotary member.

15. The high hat stand of claim 2, wherein each of the first and second rotary members comprises a sprocket having a toothed periphery and the respective first and second straps each comprise a link chain adapted to mesh with the sprocket teeth of the respective first and second sprockets.

16. The high hat stand of claim 2, wherein each of the first and second rotary members comprises a wheel.

* * * * *